US010550521B2

(12) United States Patent
Koroki

(10) Patent No.: US 10,550,521 B2
(45) Date of Patent: Feb. 4, 2020

(54) TOILET PAPER

(71) Applicant: DAIO PAPER CORPORATION, Ehime (JP)

(72) Inventor: Takahisa Koroki, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 23 days.

(21) Appl. No.: 15/763,307

(22) PCT Filed: Aug. 31, 2016

(86) PCT No.: PCT/JP2016/075498
§ 371 (c)(1),
(2) Date: Mar. 26, 2018

(87) PCT Pub. No.: WO2017/056836
PCT Pub. Date: Apr. 6, 2017

(65) Prior Publication Data

US 2018/0282948 A1 Oct. 4, 2018

(30) Foreign Application Priority Data

Sep. 30, 2015 (JP) ..... 2015-195175

(51) Int. Cl.

| | |
|---|---|
| ***D21H 27/00*** | (2006.01) |
| ***A47K 10/16*** | (2006.01) |
| ***D21H 27/30*** | (2006.01) |
| ***D21H 21/24*** | (2006.01) |
| ***D21H 23/16*** | (2006.01) |

(52) U.S. Cl.
CPC ..... *D21H 27/005* (2013.01); *A47K 10/16* (2013.01); *D21H 27/30* (2013.01); *D21H 21/24* (2013.01); *D21H 23/16* (2013.01)

(58) Field of Classification Search
CPC ..... A47K 10/16; D21H 27/00; D21H 27/005; D21H 27/30; D21H 21/22; D21H 21/24; D21H 23/14; D21H 23/16; D21H 27/002
See application file for complete search history.

(56) References Cited

U.S. PATENT DOCUMENTS

| | | | | |
|---|---|---|---|---|
| 5,624,676 | A | 4/1997 | Mackey et al. | |
| 5,716,692 | A | 2/1998 | Warner et al. | |
| 8,007,879 | B2 * | 8/2011 | Nakano | B41M 5/0017 347/101 |
| 8,049,060 | B2 | 11/2011 | Vinson et al. | |
| 8,287,986 | B2 * | 10/2012 | Huss | B31F 1/07 428/153 |
| 2005/0077020 | A1 | 4/2005 | Hirasawa | |
| 2005/0136097 | A1 | 6/2005 | Hsu | |
| 2007/0044930 | A1 | 3/2007 | Vinson et al. | |
| 2007/0071797 | A1 | 3/2007 | Hernandez-Munoa et al. | |
| 2007/0233024 | A1 | 10/2007 | Uehara et al. | |
| 2008/0087395 | A1 | 4/2008 | Prodoehl et al. | |
| 2009/0130347 | A1 * | 5/2009 | Nakano | B41M 5/0017 428/32.18 |
| 2009/0188637 | A1 | 7/2009 | Chan et al. | |
| 2009/0297781 | A1 * | 12/2009 | Huss | B31F 1/07 428/166 |
| 2011/0217345 | A1 | 9/2011 | Huang et al. | |
| 2016/0244915 | A1 | 8/2016 | Mohammadi et al. | |
| 2016/0355983 | A1 * | 12/2016 | Yamada | B31F 1/07 |
| 2017/0009402 | A1 | 1/2017 | Mohammadi et al. | |
| 2018/0094388 | A1 | 4/2018 | Mohammadi et al. | |
| 2018/0258592 | A1 * | 9/2018 | Yasui | D21H 27/005 |
| 2018/0282948 | A1 * | 10/2018 | Koroki | A47K 10/16 |
| 2019/0186078 | A1 | 6/2019 | Salaam-Zayid et al. | |

FOREIGN PATENT DOCUMENTS

| | | | | |
|---|---|---|---|---|
| EP | 1752580 | | 2/2007 | |
| EP | 3357386 | A1 * | 8/2018 | A47K 10/16 |
| JP | 2004-188078 | | 7/2004 | |
| JP | 3610337 | | 1/2005 | |
| JP | 2005-348976 | | 12/2005 | |
| JP | 2006-021020 | | 1/2006 | |
| JP | 2006-283231 | | 10/2006 | |
| JP | 2009-183411 | | 8/2009 | |
| JP | 4875488 | | 2/2012 | |
| JP | 2012-180609 | | 9/2012 | |
| JP | 5258354 | | 8/2013 | |
| JP | 5410026 | | 2/2014 | |

(Continued)

OTHER PUBLICATIONS

Extended European search report for European Patent Application No. 16851012.1 dated Aug. 14, 2018.
International Search Report for PCT/JP2016/075498 dated Dec. 6, 2016.
U.S. Office Action for U.S. Appl. No. 16/570,256 dated Oct. 15, 2019.

*Primary Examiner* — Jose A Fortuna
(74) *Attorney, Agent, or Firm* — IPUSA, PLLC

(57) ABSTRACT

A 1-ply toilet paper includes a leaf bleached kraft pulp and a needle bleached kraft pulp, as constituting fibers, mass % of the needle bleached kraft pulp being 15 to 55 mass %; 0.024 to 0.075 mass %, with respect to a mass of the pulps, of a fatty acid ester series compound; and 0.015 to 0.075 mass %, with respect to the mass of the pulps, of a fatty acid amide series compound, wherein a basis weight is 21.0 to 22.5 g/m$^2$, wherein a paper thickness is 110 to 155 μm, wherein a degree of elongation is 14 to 25%, wherein an MMD is less than 9.3, wherein dry tensile strength in a longitudinal direction is 245 to 330 cN/25 mm, and wherein dry tensile strength in a lateral direction is 85 to 135 cN/25 mm.

2 Claims, 1 Drawing Sheet

(56) References Cited

FOREIGN PATENT DOCUMENTS

| | | | | |
|---|---|---|---|---|
| JP | 5455356 | | 3/2014 | |
| JP | 6069452 | B1 * | 2/2017 | ..... A47K 10/16 |
| WO | 2005/118954 | | 12/2005 | |
| WO | WO-2017056836 | A1 * | 4/2017 | ..... A47K 10/16 |

* cited by examiner

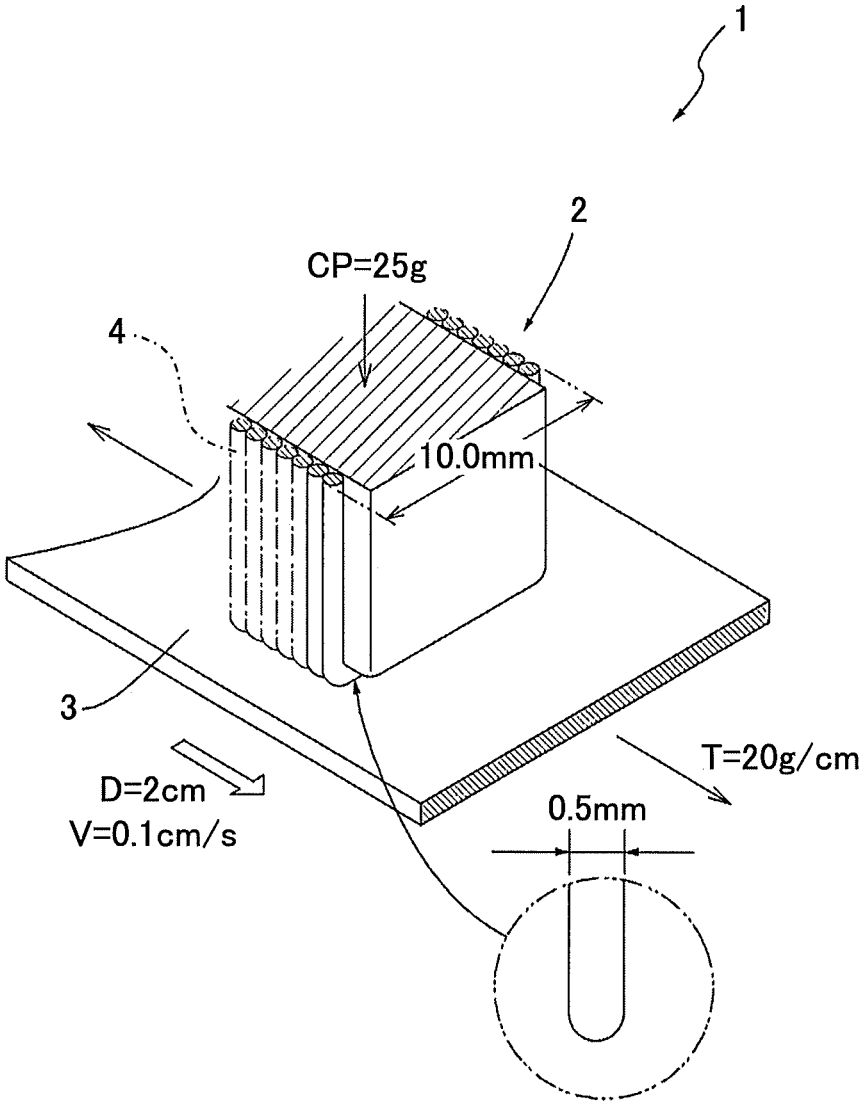
1
2
CP=25g
4
10.0mm
3
D=2cm
V=0.1cm/s
T=20g/cm
0.5mm

TOILET PAPER

BACKGROUND OF THE INVENTION

1. Field of the Invention

The present invention relates to a toilet paper and a method of manufacturing thereof.

2. Description of the Related Art

It is required for toilet paper to have a pleasant feel such as softness and smoothness, and strength that is sufficient to not be separated when cleaning skin.

It is possible to improve the pleasant feel by improving draping, by using a virgin pulp as a pulp material, and further internally adding a softener.

However, the internally added softener has a function to lower paper strength, and it is difficult to give both a pleasant feel and strength of a paper just by internally adding the softener.

Patent Document

Patent Document 1: Japanese Patent No. 4875488

SUMMARY OF THE INVENTION

The present invention is made mainly to provide a toilet paper having a pleasant feel such as smoothness in addition to softness and strength that is sufficient to hardly be separated when cleaning.

According to an embodiment, there is provided a 1-ply toilet paper including: a leaf bleached kraft pulp and a needle bleached kraft pulp, as constituting fibers, mass % of the needle bleached kraft pulp being 15 to 55 mass %; 0.024 to 0.075 mass %, with respect to a mass of the pulps, of a fatty acid ester series compound; and 0.015 to 0.075 mass %, with respect to the mass of the pulps, of a fatty acid amide series compound, wherein a basis weight is 21.0 to 22.5 g/m$^2$, wherein a paper thickness is 110 to 155 μm, wherein a degree of elongation is 14 to 25%, wherein an MMD is less than 9.3, wherein dry tensile strength in a longitudinal direction is 245 to 330 cN/25 mm, and wherein dry tensile strength in a lateral direction is 85 to 135 cN/25 mm.

According to another embodiment, there is provided a 2-ply toilet paper of including: a leaf bleached kraft pulp and a needle bleached kraft pulp, as constituent fibers, mass % of the needle bleached kraft pulp being 15 to 55 mass %; 0.024 to 0.075 mass %, with respect to a mass of the pulps, of a fatty acid ester series compound; and 0.015 to 0.075 mass %, with respect to the mass of the pulps, of a fatty acid amide series compound, wherein a basis weight per ply is 15.8 to 17.5 g/m$^2$, wherein a paper thickness is 110 to 155 μm, wherein a degree of elongation per ply is 13.0 to 22%, wherein an MMD is less than 9.3, wherein dry tensile strength in a longitudinal direction per ply is 130 to 175 cN/25 mm, and wherein dry tensile strength in a lateral direction per ply is 45 to 75 cN/25 mm.

According to another embodiment, there is provided a method of manufacturing a toilet paper, including: adding, to a paper material including a leaf bleached kraft pulp and a needle bleached kraft pulp whose mass % is 15 to 55 mass %, as fiber materials, 0.08 to 0.15 mass %, with respect to a mass of the pulps, of a fatty acid ester series compound whose particle size is less than or equal to 0.1 μm, and 0.05 to 0.15 mass %, with respect to the mass of the pulps, of a fatty acid amide series compound whose particle size is 0.5 to 5 μm in this order, to make a paper of a paper material in which the fatty acid ester series compound and the fatty acid amide series compound are added.

According to the above invention, a toilet paper having a pleasant feel such as smoothness in addition to softness and strength that is sufficient to hardly be separated (torn or broken) when cleaning.

BRIEF DESCRIPTION OF THE DRAWINGS

FIG. 1 is a view for describing a method of measuring an MMD of an embodiment.

DETAILED DESCRIPTION OF THE PREFERRED EMBODIMENTS

Hereinafter, embodiments of the present invention are described. A toilet paper of the embodiment targets a product of 1-ply which is also referred as single, or a product of 2-ply which is also referred as double.

Constituting fibers of the toilet paper of the embodiment are a needle bleached kraft pulp (NBKP) and a leaf bleached kraft pulp (LBKP). In particular, 15 to 55 mass % of the needle bleached kraft pulp is included. Generally, for pulp fibers, when included percentage of the leaf bleached kraft pulp is increased, paper strength is lowered and softness is increased. On the other hand, when included percentage of the needle bleached kraft pulp is increased, paper strength is increased and softness is lowered. In this embodiment, in particular, by setting the included percentage of the needle bleached kraft pulp to be greater than or equal to 15 mass %, sufficient paper strength can be obtained, and by setting to be less than or equal to 55 mass %, softness can be increased.

In this embodiment, for a case of 1-ply (single), a basis weight of the toilet paper may be 21.0 to 22.5 g/m$^2$. By setting the basis weight to be greater than or equal to 21.0 g/m$^2$ for the 1-ply toilet paper, it is easy to obtain necessary strength in cleaning. Further, by setting the basis weight to be less than or equal to 22.5 g/m$^2$, softness can be improved.

Further, for a case of 2-ply (double), a basis weight per ply constituting the 2-ply paper may be 15.8 to 17.5 g/m$^2$. For the case of 2-ply, by setting the basis weight per ply to be greater than or equal to 15.8 g/m$^2$, it is easy to obtain necessary strength in cleaning. Further, by setting the basis weight per ply to be less than or equal to 17.5 g/m$^2$, softness can be improved.

Here, the basis weight of the embodiment means a value measured based on JIS P 8124 (1998).

A paper thickness of the toilet paper of the embodiment may be 110 to 155 μm. This paper thickness is a paper thickness per ply even for a 2-ply product. By setting the paper thickness to be greater than or equal to 110 mm, it is easy to obtain necessary strength in cleaning. Further, by setting the paper thickness to be less than or equal to 155 μm, softness can be obtained.

The paper thickness means a value measured by, after sufficiently moisture conditioning a test piece under a condition based on JIS P 8111 (1998), a dial thickness gauge (thickness gauge) "PEACOCK G" (manufactured by OZAKI MFG. CO., LTD.) under a condition based on JIS P 8111 (1998). Specific procedures of the paper thickness measurement are, lowering a plunger is on a measurement base after confirming that there are no rubbishes, dusts and the like between the plunger and the measurement base, matching a zero point by moving a memory of the dial thickness gauge, placing a sample on the measurement base after rising the plunger, and slowly lowering the plunger to read the gauge at this time. At this time, the plunger is just placed on the measurement base. A terminal of the plunger is made of a metal, and is operated such that a flat circular surface thereof, whose diameter is 10 mm, perpendicularly touches a paper planar surface, where a load at the paper thickness measurement is approximately 70 gf. An average value obtained by measuring 10 times is used.

Here, according to the toilet paper of the embodiment, in order to sufficiently improve three requirements of softness, smoothness and sufficient strength within ranges of the above described basis weight and the paper thickness, respectively, specific softener compounds are used. The softener compounds of the toilet paper of the embodiment are a fatty acid ester series compound and a fatty acid amide series compound, and in particular, the content of the fatty acid ester series compound is 0.024 to 0.075 mass % with respect to a mass of the pulps, and the content of the fatty acid amide series compound is 0.015 to 0.075 mass % with respect to the mass of the pulps.

Both of the fatty acid amide series compound and the fatty acid ester series compound are capable of improving flexibility (softness). The fatty acid amide series compound further has an effect of improving smoothness of a surface. Meanwhile, the fatty acid ester series compound has an effect of increasing softness originated from light bulkiness.

When the content of the fatty acid amide series compound is greater than or equal to 0.015 mass % with respect to the mass of the pulps in the toilet paper of the embodiment, sufficient smoothness can be obtained. Further, when the content of the fatty acid ester series compound is greater than or equal to 0.024 mass % with respect to the mass of the pulps, smoothness and lightness can be obtained. In other words, when the content of the fatty acid amide series compound is greater than or equal to 0.015 mass % with respect to the mass of the pulps, and also the content of the fatty acid ester series compound is greater than or equal to 0.024 mass % with respect to the mass of the pulps, smoothness and softness can be improved.

Meanwhile, even when the content of the fatty acid amide series compound exceeds 0.075 mass % with respect to the mass of the pulps, smoothness is not improved more. Further, when the content of the fatty acid ester series compound is less than or equal to 0.075 mass % with respect to the mass of the pulps, sufficient strength can be obtained.

In this embodiment, the content of the fatty acid amide series compound may be greater than or equal to 0.015 mass % with respect to the mass of the pulps, and also, the content of the fatty acid ester series compound may be greater than or equal to 0.024 mass % with respect to the mass of the pulps, and also, the content of the fatty acid amide series compound may be less than or equal to 0.075 mass % with respect to the mass of the pulps, and also, the content of the fatty acid ester series compound may be less than or equal to 0.075 mass % with respect to the mass of the pulps. With this, the three requirements of softness, smoothness and sufficient strength can be effectively satisfied by using the fatty acid amide series compound and the fatty acid ester series compound. As such, according to the toilet paper of the embodiment, by configuring to include the fatty acid amide series compound and the fatty acid ester series compound with the above described ranges, respectively, at the above described basis weight and the paper thickness for each of 1-ply and 2-ply, all of smoothness, softness, and further strength necessary when cleaning are improved.

Here, the fatty acid ester series compound and the fatty acid amide series compound are internally added. As a method of internally adding them, in particular, when making a paper of a paper material in which pulp slurries are included or an appropriate amount of auxiliaries are further included in addition to the pulp slurries, the fatty acid ester series compound is added first, and thereafter, the fatty acid amide series compound is added. More specifically, it is preferable that the fatty acid ester series compound is added in a mixing tank in a papering step, and the fatty acid amide series compound is added in a seed box in the papering step.

Here, for other manufacturing steps of the toilet paper of the embodiment, the toilet paper may be manufactured by following a normal method of manufacturing a general toilet paper.

Here, a fixation rate of the fatty acid ester series compound and the fatty acid amide series compound to the pulp fiber is approximately 30 to 50%. Thus, when manufacturing, considering this, 0.08 to 0.15 mass % of the fatty acid ester series compound with respect to the mass of the pulps, and 0.05 to 0.15 mass % of the fatty acid amide series compound with respect to the mass of the pulps may be used.

The fatty acid ester series compound enters lumens (inner hole portions) of the fibrillated pulp fiber, and prevents deflation of the lumens of the pulp fiber due to hydrogen bonds, when a wet web is dried to become a dry web after completing making the paper. Further, the fatty acid amide series compound functions to coat a surface of the pulp fiber to improve smoothness of the surface.

Then, as described above, by providing time different between an action mechanism by the fatty acid ester series compound and an action mechanism by the fatty acid amide series compound, it is possible to extremely effectively obtain smoothness, softness, and strength necessary when cleaning.

Further, in particular, with respect to the percentages of the needle bleached kraft pulp and the leaf bleached kraft pulp of the toilet paper of the embodiment, it is preferable to use the fatty acid ester series compound whose particle size is less than or equal to 0.1 μm, and the fatty acid amide series compound whose particle size is 0.5 μm to 5 μm. The fatty acid ester series compound whose particle size is less than or equal to 0.1 μm is easily penetrated into the lumens in the pulp fiber, and the effects of the embodiment can be more effectively obtained. Further, the fatty acid amide series compound of 0.5 μm to 5 μm shows a good coating function to, particularly, a surface of the pulp fiber of the embodiment. When the particle size is larger than the above range, there is a rick that the coating function to the surface of the pulp fiber becomes insufficient.

Here, the particle size of the embodiment is a median diameter, is based on JIS Z 8825:2013, and is obtained by measuring particle size distribution of an emulsion obtained by emulsification by laser light scattering.

As the fatty acid ester series compound of the embodiment, although either of a cationic fatty acid ester series compound and a nonionic fatty acid ester series compound may be used, it is desirable that both of them are included. Further, as the fatty acid ester series compound, it is desirable to use a compound of an alcohol whose carbon number is 6 to 24 and a fatty acid whose carbon number is 7 to 25. The alcohol may be either of a straight chain alcohol, an alcohol including a branched chain, a saturated alcohol and an unsaturated alcohol. In particular, it is preferable to use an alcohol whose carbon number is 10 to 22, and lauryl alcohol, myristyl alcohol, cetyl alcohol, stearyl alcohol, behenyl alcohol and oleyl alcohol are preferable. One type of them may be solely used, or a combination of two or more types of them may be used. As the fatty acid whose carbon number is 7 to 25, either of a straight chain fatty acid, a fatty acid including a branched chain, a saturated fatty acid and an unsaturated fatty acid may be used. In particular, a fatty acid whose carbon number is 10 to 22 is preferable, and lauric acid, myristic acid, palmitic acid, stearic acid, behenic acid and oleic acid are preferable. One type of them may be solely used, or a combination of two or more types of them may be used.

Meanwhile, the fatty acid amide series compound may be obtained by reacting a polyalkylene polyamine and a carboxylic acid. A preferable polyalkylene polyamine is one expressed by the following formula (1) that includes at least three amino groups in a molecule.

$$H_2N—(R1\text{-}NH\text{-})n\text{-}R1\text{-}NH_2 \quad (1)$$

(each "R1" is independently an alkylene group whose carbon number is 1 to 4, and "n" is an integer from 1 to 3)

In this polyacrylamine, different "R1" may be included in a molecule. Further, two or more types of polyalkylenepolyamines may be used. Preferable "R1" is an ethylene group.

Meanwhile, as the carboxylic acid, a carboxylic acid whose carbon number is 10 to 24 is preferable, and either of a saturated carboxylic acid and an unsaturated carboxylic acid may be used. Further, either of a straight chain carboxylic acid and a carboxylic acid including a branched chain may be used. Among them, a carboxylic acid whose carbon number is 12 to 22 is preferable, and in particular, a carboxylic acid whose carbon number is 14 to 18 is preferable.

Meanwhile, a degree of elongation of the toilet paper of the embodiment for the case of 1-ply is 14 to 25%. Further, for the case of 2-ply, a degree of elongation per ply is 13.0 to 22%. The degree of elongation of the toilet paper is largely influenced by a crepe structure, and in particular, for a product having the above described degree of elongation, in combination with the above described basis weight, the paper thickness and the softener compounds, smoothness of a surface can be obtained, and further, strength necessary when cleaning can also be obtained. The elongation is a value measured by a load cell tensile testing machine (manufactured by Minebea, Technograph TG-200N) based on a test method of JIS P 8132. A width of a test piece is 25 mm, and an average value of five time measurements in each direction is used. Here, the degree of elongation can be adjusted by a crape ratio in manufacturing steps, and in particular for the present embodiment, the crape ratio may be 15 to 27%.

As specific strength of the toilet paper of the embodiment, for the case of 1-ply, dry tensile strength in a longitudinal direction (MD direction) is 245 to 330 cN/25 mm, and dry tensile strength in a lateral direction (CD direction) is 85 to 135 cN/25 mm. Further, for the case of 2-ply, the dry tensile strength in the longitudinal direction per ply is 130 to 175 cN/25 mm, and the dry tensile strength in the lateral direction per ply is 45 to 75 cN/25 mm. Here, the dry tensile strength of the embodiment means a value measured based on a tensile test of JIS P 8113 (1998).

Meanwhile, an MMD (a mean deviation of coefficient of friction: Fluctuations of average Frictional Coefficient) of the toilet paper of the embodiment is less than 9.3. The MMD is an index of smoothness, and within the above range, a user can feel extreme smoothness of a surface when cleaning, in particular, when cleaning skin after egestion, which is a main purpose of toilet paper.

FIG. 1 is a view illustrating an example of a structure of an MMD measurement device 1 for measuring an MMD. In the MMD measurement device 1, a contact surface of a friction block 2 is moved, while contacting a surface of a measurement sample 3, to which tension "T" of 20 g/cm is applied in a predetermined direction, with contact pressure "CP" of 25 g, for 2 cm at a speed V=0.1 cm/s, in a direction substantially the same as the direction in which the tension "T" is applied. Coefficient of friction at this time is measured by using a friction tester KES-SE (manufactured by KATO TECH CO., LTD.). The MMD is a value obtained by dividing the coefficient of friction by a friction distance (moved distance D=2 cm). The friction block 2 is composed of 20 adjacent piano wires 4 each of which has a diameter of 0.5 mm and is configured to have the contact surface whose length and the width are both 10 mm. A unit evaginating portion whose front end is formed by the 20 piano wires 4 (radius of curvature 0.25 mm) is formed at the contact surface.

Adjusting the MMD to be the above range in this embodiment may be easily accomplished by adding the softener compounds by the mass ratios with respect to the pulp fiber at the above described basis weight and the paper thickness, and similar to the dry tensile strength and the like, the MMD can be further adjusted by a crape ratio or a type of the pulp fiber and a composition of the pulp fiber in manufacturing.

EXAMPLES

Next, examples and comparative examples of the toilet paper of the embodiment are manufactured, and physical property values such as the tensile strength and the MMD of each of them were measured, and a sensory test of smoothness and hardly be separated in use was conducted. In the sensory test, a reference sample (comparative example 1 for a 1-ply toilet paper, and comparative example 5 for a 2-ply toilet paper) was set to be "2", and it was evaluated to be "3" for a case which was felt to be better than the reference sample, and evaluated to be "1" for a case which was felt to be worse than the reference sample. 12 test subjects were used. Values in tables are average values of the test subjects. Composition and physical property values of each example are as illustrated the following Table 1 to Table 4. Here, Table 1 and Table 2 are examples and comparative examples regarding 1-ply toilet papers, and Table 3 and Table 4 are examples and comparative examples regarding the 2-ply toilet papers.

TABLE 1

| | | | | EXAMPLE 1 | EXAMPLE 2 | EXAMPLE 3 | EXAMPLE 4 | EXAMPLE 5 |
|---|---|---|---|---|---|---|---|---|
| ITEMS REGARDING MANUFACTURING | PULP COMPOSITION | NBKP | [MASS %] | 45.0 | 45.0 | 45.0 | 45.0 | 45.0 |
| | | LBKP | [MASS %] | 55.0 | 55.0 | 55.0 | 55.0 | 55.0 |
| | CREPE RATIO | | [%] | 23.0 | 23.0 | 23.0 | 23.0 | 23.0 |
| | ADDED AMOUNT OF FATTY ACID ESTER SERIES COMPOUND A WITH RESPECT TO MASS OF PULPS (ϕ0.1 μm or less) | | [MASS %] | 0.080 | 0.095 | 0.105 | 0.100 | 0.115 |

TABLE 1-continued

| | | | | EXAMPLE 1 | EXAMPLE 2 | EXAMPLE 3 | EXAMPLE 4 | EXAMPLE 5 |
|---|---|---|---|---|---|---|---|---|
| | ADDED AMOUNT OF FATTY ACID AMIDE SERIES COMPOUND B WITH RESPECT TO MASS OF PULPS (ϕ0.5-5.0 μm) | | [MASS %] | 0.050 | 0.085 | 0.100 | 0.100 | 0.150 |
| | ADDED AMOUNT OF FATTY ACID AMIDE SERIES COMPOUND C WITH RESPECT TO MASS OF PULPS (ϕ10-20 μm) | | [MASS %] | — | — | — | — | — |
| ITEMS REGARDING PRODUCT | PULP COMPOSITION | NBKP | [MASS %] | 45.0 | 45.0 | 45.0 | 45.0 | 45.0 |
| | | LBKP | [MASS %] | 55.0 | 55.0 | 55.0 | 55.0 | 55.0 |
| | BASIS WEIGHT | | [g/m$^2$] | 21.6 | 21.6 | 21.9 | 21.8 | 21.6 |
| | PAPER THICKNESS (1 PLY) | | [μm] | 139 | 131 | 133 | 139 | 130 |
| | DRY TENSILE STRENGTH | MD DIRECTION | [cN/25 mm] | 325 | 316 | 297 | 309 | 300 |
| | DRY TENSILE STRENGTH | CD DIRECTION | [cN/25 mm] | 131 | 132 | 133 | 124 | 128 |
| | DEGREE OF ELONGATION | | [%] | 17.9 | 19.8 | 18.4 | 18.5 | 17.8 |
| | MMD | | [—] | 9.2 | 9.1 | 8.5 | 8.8 | 8.4 |
| | CONTENT OF FATTY ACID ESTER SERIES COMPOUND A WITH RESPECT TO MASS OF PULPS (ϕ0.1 μm or less) | | [MASS %] | 0.024 | 0.038 | 0.042 | 0.040 | 0.046 |
| | CONTENT OF FATTY ACID AMIDE SERIES COMPOUND B WITH RESPECT TO MASS OF PULPS (ϕ0.5-5.0 μm) | | [MASS %] | 0.015 | 0.034 | 0.040 | 0.040 | 0.060 |
| | CONTENT OF FATTY ACID AMIDE SERIES COMPOUND C WITH RESPECT TO MASS OF PULPS (ϕ10-20 μm) | | [MASS %] | — | — | — | — | — |
| | SENSORY EVALUATION (SMOOTHNESS) | | | 2.5 | 2.6 | 2.8 | 2.7 | 2.8 |
| | SENSORY EVALUATION (HARDLY BE SEPARATED) | | | 2.6 | 2.4 | 2.2 | 2.5 | 2.3 |

TABLE 2

| | | | | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|---|---|
| ITEMS RE-GARDING MANU-FAC-TURING | PULP COMPOSITION | NBKP | [MASS %] | 45.0 | 45.0 | 45.0 | 45.0 |
| | | LBKP | [MASS %] | 55.0 | 55.0 | 55.0 | 55.0 |
| | CREPE RATIO | | [%] | 23.0 | 23.0 | 23.0 | 23.0 |
| | ADDED AMOUNT OF FATTY ACID ESTER SERIES COMPOUND A WITH RESPECT TO MASS OF PULPS (ϕ0.1 μm or less) | | [MASS %] | 0.080 | 0.160 | 0.050 | — |
| | ADDED AMOUNT OF FATTY ACID AMIDE SERIES COMPOUND B WITH RESPECT TO MASS OF PULPS (ϕ0.5-5.0 μm) | | [MASS %] | — | 0.030 | 0.130 | 0.180 |
| | ADDED AMOUNT OF FATTY ACID AMIDE SERIES COMPOUND C WITH RESPECT TO MASS OF PULPS (ϕ10-20 μm) | | [MASS %] | 0.170 | — | — | 0.200 |
| ITEMS RE-GARDING PROD-UCT | PULP COMPOSITION | NBKP | [MASS %] | 45.0 | 45.0 | 45.0 | 45.0 |
| | | LBKP | [MASS %] | 55.0 | 55.0 | 55.0 | 55.0 |
| | BASIS WEIGHT | | [g/m$^2$] | 21.95 | 21.9 | 21.6 | 21.2 |
| | PAPER THICKNESS (1 PLY) | | [μm] | 128.2 | 128 | 134 | 132 |
| | DRY TENSILE STRENGTH | MD DIRECTION | [cN/25 mm] | 293 | 240 | 339 | 344 |
| | DRY TENSILE STRENGTH | CD DIRECTION | [cN/25 mm] | 113 | 84 | 139 | 142 |
| | DEGREE OF ELONGATION | | [%] | 19.5 | 17.5 | 17.8 | 18.8 |
| | MMD | | [—] | 10.0 | 9.8 | 9.0 | 8.8 |
| | CONTENT OF FATTY ACID ESTER SERIES COMPOUND A WITH RESPECT TO MASS OF PULPS (ϕ0.1 μm or less) | | [MASS %] | 0.040 | 0.080 | 0.020 | — |
| | CONTENT OF FATTY ACID AMIDE SERIES COMPOUND B WITH RESPECT TO MASS OF PULPS (ϕ0.5-5.0 μm) | | [MASS %] | — | 0.012 | 0.052 | 0.090 |
| | CONTENT OF FATTY ACID AMIDE SERIES COMPOUND C WITH RESPECT TO MASS OF PULPS (ϕ10-20 μm) | | [MASS %] | 0.085 | — | — | 0.100 |
| | SENSORY EVALUATION (SMOOTHNESS) | | | 2 | 1.7 | 1.4 | 1.4 |
| | SENSORY EVALUATION (HARDLY BE SEPARATED) | | | 2 | 1.7 | 2.8 | 3.0 |

TABLE 3

| | | | | EXAMPLE 6 | EXAMPLE 7 | EXAMPLE 8 | EXAMPLE 9 |
|---|---|---|---|---|---|---|---|
| ITEMS RE-GARDING MANU- | PULP COMPOSITION | NBKP | [MASS %] | 26.0 | 26.0 | 26.0 | 26.0 |
| | | LBKP | [MASS %] | 74.0 | 74.0 | 74.0 | 74.0 |
| | CREPE RATIO | | [%] | 23 | 23 | 23 | 23 |
| | ADDED AMOUNT OF FATTY ACID ESTER | | [MASS %] | 0.080 | 0.110 | 0.130 | 0.100 |

TABLE 3-continued

| | | | | EXAMPLE 6 | EXAMPLE 7 | EXAMPLE 8 | EXAMPLE 9 |
|---|---|---|---|---|---|---|---|
| FAC-TURING | SERIES COMPOUND A WITH RESPECT TO MASS OF PULPS (φ0.1 μm or less) | | | | | | |
| | ADDED AMOUNT OF FATTY ACID AMIDE SERIES COMPOUND B WITH RESPECT TO MASS OF PULPS (φ0.5-5.0 μm) | | [MASS %] | 0.050 | 0.080 | 0.100 | 0.150 |
| | ADDED AMOUNT OF FATTY ACID AMIDE SERIES COMPOUND C WITH RESPECT TO MASS OF PULPS (φ10-20 μm) | | [MASS %] | — | — | — | — |
| ITEMS RE-GARDING PROD-UCT | PULP COMPOSITION | NBKP | [MASS %] | 26.0 | 26.0 | 26.0 | 26.0 |
| | | LBKP | [MASS %] | 74.0 | 74.0 | 74.0 | 74.0 |
| | BASIS WEIGHT | | [g/m$^2$] | 16.3 | 16.7 | 16.5 | 16.8 |
| | PAPER THICKNESS (1 PLY) | | [μm] | 125 | 118 | 119 | 120 |
| | DRY TENSILE STRENGTH (1 PLY) | MD DIRECTION | [cN/25 mm] | 159 | 159 | 152 | 149 |
| | DRY TENSILE STRENGTH (1 PLY) | CD DIRECTION | [cN/25 mm] | 64 | 65 | 58 | 58 |
| | DEGREE OF ELONGATION | | [%] | 15.6 | 16.2 | 17.9 | 13.6 |
| | MMD | | [—] | 9.2 | 8.9 | 8.5 | 8.1 |
| | CONTENT OF FATTY ACID ESTER SERIES COMPOUND A WITH RESPECT TO MASS OF PULPS (φ0.1 μm or less) | | [MASS %] | 0.024 | 0.044 | 0.052 | 0.040 |
| | CONTENT OF FATTY ACID AMIDE SERIES COMPOUND B WITH RESPECT TO MASS OF PULPS (φ0.5-5.0 μm) | | [MASS %] | 0.015 | 0.032 | 0.040 | 0.060 |
| | CONTENT OF FATTY ACID AMIDE SERIES COMPOUND C WITH RESPECT TO MASS OF PULPS (φ10-20 μm) | | [MASS %] | — | — | — | — |
| | SENSORY EVALUATION (SMOOTHNESS) | | | 2.4 | 2.6 | 2.7 | 2.8 |
| | SENSORY EVALUATION (HARDLY BE SEPARATED) | | | 2.3 | 2.4 | 2.3 | 2.2 |

TABLE 4

| | | | | COMPAR-ATIVE EXAMPLE 5 | COMPAR-ATIVE EXAMPLE 6 | COMPAR-ATIVE EXAMPLE 7 | COMPAR-ATIVE EXAMPLE 8 |
|---|---|---|---|---|---|---|---|
| ITEMS RE-GARDING MANU-FAC-TURING | PULP COMPOSITION | NBKP | [MASS %] | 26.0 | 26.0 | 26.0 | 26.0 |
| | | LBKP | [MASS %] | 74.0 | 74.0 | 74.0 | 74.0 |
| | CREPE RATIO | | [%] | 23 | 23 | 23 | 23 |
| | ADDED AMOUNT OF FATTY ACID ESTER SERIES COMPOUND A WITH RESPECT TO MASS OF PULPS (φ0.1 μm or less) | | [MASS %] | 0.100 | 0.170 | 0.070 | — |
| | ADDED AMOUNT OF FATTY ACID AMIDE SERIES COMPOUND B WITH RESPECT TO MASS OF PULPS (φ0.5-5.0 μm) | | [MASS %] | — | 0.030 | 0.170 | 0.180 |
| | ADDED AMOUNT OF FATTY ACID AMIDE SERIES COMPOUND C WITH RESPECT TO MASS OF PULPS (φ10-20 μm) | | [MASS %] | 0.200 | — | — | 0.200 |
| ITEMS RE-GARDING PROD-UCT | PULP COMPOSITION | NBKP | [MASS %] | 26.0 | 26.0 | 26.0 | 26.0 |
| | | LBKP | [MASS %] | 74.0 | 74.0 | 74.0 | 74.0 |
| | BASIS WEIGHT | | [g/m$^2$] | 16.4 | 16.5 | 16.9 | 16.7 |
| | PAPER THICKNESS (1 PLY) | | [μm] | 127 | 117 | 129 | 126 |
| | DRY TENSILE STRENGTH (1 PLY) | MD DIRECTION | [cN/25 mm] | 157 | 126 | 178 | 187 |
| | DRY TENSILE STRENGTH (1 PLY) | CD DIRECTION | [cN/25 mm] | 65 | 50 | 76 | 82 |
| | DEGREE OF ELONGATION | | [%] | 13.8 | 19.8 | 15.1 | 18.0 |
| | MMD | | [—] | 9.6 | 9.3 | 8.0 | 8.2 |
| | CONTENT OF FATTY ACID ESTER SERIES COMPOUND A WITH RESPECT TO MASS OF PULPS (φ0.1 μm or less) | | [MASS %] | 0.050 | 0.077 | 0.026 | — |
| | CONTENT OF FATTY ACID AMIDE SERIES COMPOUND B WITH RESPECT TO MASS OF PULPS (φ0.5-5.0 μm) | | [MASS %] | — | 0.012 | 0.085 | 0.090 |
| | CONTENT OF FATTY ACID AMIDE SERIES COMPOUND C WITH RESPECT TO MASS OF PULPS (φ10-20 μm) | | [MASS %] | 0.080 | — | — | 0.080 |
| | SENSORY EVALUATION (SMOOTHNESS) | | | 2 | 2.1 | 1.6 | 1.5 |
| | SENSORY EVALUATION (HARDLY BE SEPARATED) | | | 2 | 1.5 | 2.6 | 2.8 |

According to results of Table 1 to Table 4, for either of 1-ply and 2-ply, it was confirmed that examples (examples 1 to 5 and examples 6 to 9) were better than the reference sample in the sensory test, for each of which the composition of the pulp fiber, the basis weight and the paper thickness were set to be within ranges of the above described embodiment, and further, the fatty acid ester series compound A and the fatty acid amide series compound B, which were the softener compounds, were included at the contents of the embodiment.

For each of comparative example 2 and comparative example 6, in which the content of the fatty acid amide series compound B was small, the value of the MMD was high and the sensory evaluation of smoothness was low. Further, for each of comparative example 3 and comparative example 7, in which the content of the fatty acid ester series compound A was small, although the paper strength was high, the evaluation of the hardly be separated was high and the MMD was low, the evaluation of the smoothness was low. This is because when the paper strength increases, smoothness is hard to be sensory felt. Further, for each of comparative example 4 and comparative example 8, in which the fatty acid ester series compound A was not included, the paper strength became extremely high, and although not expressed as the MMD, the evaluation of the smoothness in the sensory test was extremely low. Further, when comparing each of comparative example 3, comparative example 4, comparative example 7 and comparative example 8, the MMD was not lowered even when the content of the fatty acid amide series compound B or C was excessive.

From the above described results of examples and comparative examples, by adopting the structure of the embodiment, a toilet paper for which the softness, the smoothness and the strength are improved and having strength that is sufficient to hardly be separated when cleaning skin can be obtained.

Although a preferred embodiment and example of the present invention are specifically illustrated and described, it is to be understood that the present invention is not limited to the specifically described embodiment and example, and minor modifications may be made therein without departing from the spirit and scope of the invention as defined by the claims.

The present application is based on and claims the benefit of priority of Japanese Priority Application No. 2015-195175 filed on Sep. 30, 2015, the entire contents of which are hereby incorporated by reference.

What is claimed is:

1. A 1-ply toilet paper comprising:

a leaf bleached kraft pulp and a needle bleached kraft pulp, as constituting fibers, mass % of the needle bleached kraft pulp being 15 to 55 mass %;

0.024 to 0.075 mass %, with respect to a mass of the pulps, of a fatty acid ester series compound; and 0.015 to 0.075 mass %, with respect to the mass of the pulps, of a fatty acid amide series compound, wherein a basis weight is 21.0 to 22.5 g/m$^2$, wherein a paper thickness is 110 to 155 μm, wherein a degree of elongation is 14 to 25%, wherein an MMD is less than 9.3, wherein dry tensile strength in a longitudinal direction is 245 to 330 cN/25 mm, and wherein dry tensile strength in a lateral direction is 85 to 135 cN/25 mm.

2. A 2-ply toilet paper comprising:

a leaf bleached kraft pulp and a needle bleached kraft pulp, as constituent fibers, mass % of the needle bleached kraft pulp being 15 to 55 mass %;

0.024 to 0.075 mass %, with respect to a mass of the pulps, of a fatty acid ester series compound; and 0.015 to 0.075 mass %, with respect to the mass of the pulps, of a fatty acid amide series compound, wherein a basis weight per ply is 15.8 to 17.5 g/m$^2$, wherein a paper thickness is 110 to 155 μm, wherein a degree of elongation per ply is 13.0 to 22%, wherein an MMD is less than 9.3, wherein dry tensile strength in a longitudinal direction per ply is 130 to 175 cN/25 mm, and wherein dry tensile strength in a lateral direction per ply is 45 to 75 cN/25 mm.

* * * * *